US006824354B2

(12) United States Patent
Laing

(10) Patent No.: US 6,824,354 B2
(45) Date of Patent: Nov. 30, 2004

(54) PUMP WITH SELECTABLE SUCTION PORTS

(75) Inventor: Karsten Andreas Laing, La Jolla, CA (US)

(73) Assignees: Oliver Laing, Remseck (DE); Karsten Laing, Remseck (DE); Birger Laing, Remseck (DE)

( * ) Notice: Subject to any disclaimer, the term of this patent is extended or adjusted under 35 U.S.C. 154(b) by 0 days.

(21) Appl. No.: 10/668,942

(22) Filed: Sep. 22, 2003

(65) Prior Publication Data

US 2004/0057851 A1 Mar. 25, 2004

Related U.S. Application Data

(62) Division of application No. 10/054,456, filed on Jan. 24, 2002, now Pat. No. 6,648,595.

(51) Int. Cl.[7] ..... F04D 29/00

(52) U.S. Cl. ..... 415/129; 416/170 R; 417/423.1; 417/423.7

(58) Field of Search ..... 415/130, 129; 416/170 R; 417/423.1, 423.7

(56) References Cited

U.S. PATENT DOCUMENTS

| | | | | |
|---|---|---|---|---|
| 2,810,345 A | * | 10/1957 | Englesson | 417/338 |
| 4,091,644 A | | 5/1978 | Bochan | |
| 4,177,018 A | * | 12/1979 | Granet | 417/338 |
| 4,728,260 A | | 3/1988 | Ishii | |
| 4,874,300 A | * | 10/1989 | Laing et al. | 417/420 |
| 4,923,366 A | | 5/1990 | Kern et al. | |

* cited by examiner

*Primary Examiner*—Ninh H. Nguyen
(74) *Attorney, Agent, or Firm*—Foley & Lardner LLP

(57) ABSTRACT

A circulator pump-motor unit which has an impeller assembly that can selectively tilt between two positions is disclosed. Each of the two positions corresponds to aligning a suction port with one of two inlet ports. The unit can be used to, for example, change the path of hot water conveyed between these ports so that either a hot water system or a hydronic system gets heat.

8 Claims, 3 Drawing Sheets

PUMP WITH SELECTABLE SUCTION PORTS

RELATED APPLICATIONS

This application is a divisional application of U.S. patent application Ser. No. 10/054,456, filed Jan. 24, 2002, now U.S. Pat. No. 6,648,595 which is hereby incorporated by reference in its entirety and from which priority is claimed.

FIELD OF THE INVENTION

The invention refers to circulator pumps with two inlet ports and means to control these ports.

BACKGROUND

Instant hot water heaters are used alternatively to heat the domestic hot water and the heat carrier water of hydronic systems. For this purpose a three-way-valve is connected in series with the circulator pump whose first inlet port is connected with the domestic hot water circuit and whose second inlet port is connected with the hydronic circuit. When hot water is needed, the first inlet port is connected with the suction port of the impeller of the circulator pump; the change to room heating requires the closing of this first port and the opening of the second port, which needs two solenoid valves.

SUMMARY OF THE INVENTION

The invention shows a way to switch the suction port of a circulator pump from the first to the second circuit without any valves. This method is not restricted to circulator pumps for instant hot water heaters. According to the embodiments of the invention an electric circulator pump with spherical rotor is used.

DETAILED DESCRIPTION OF THE DRAWINGS

Figure 1:
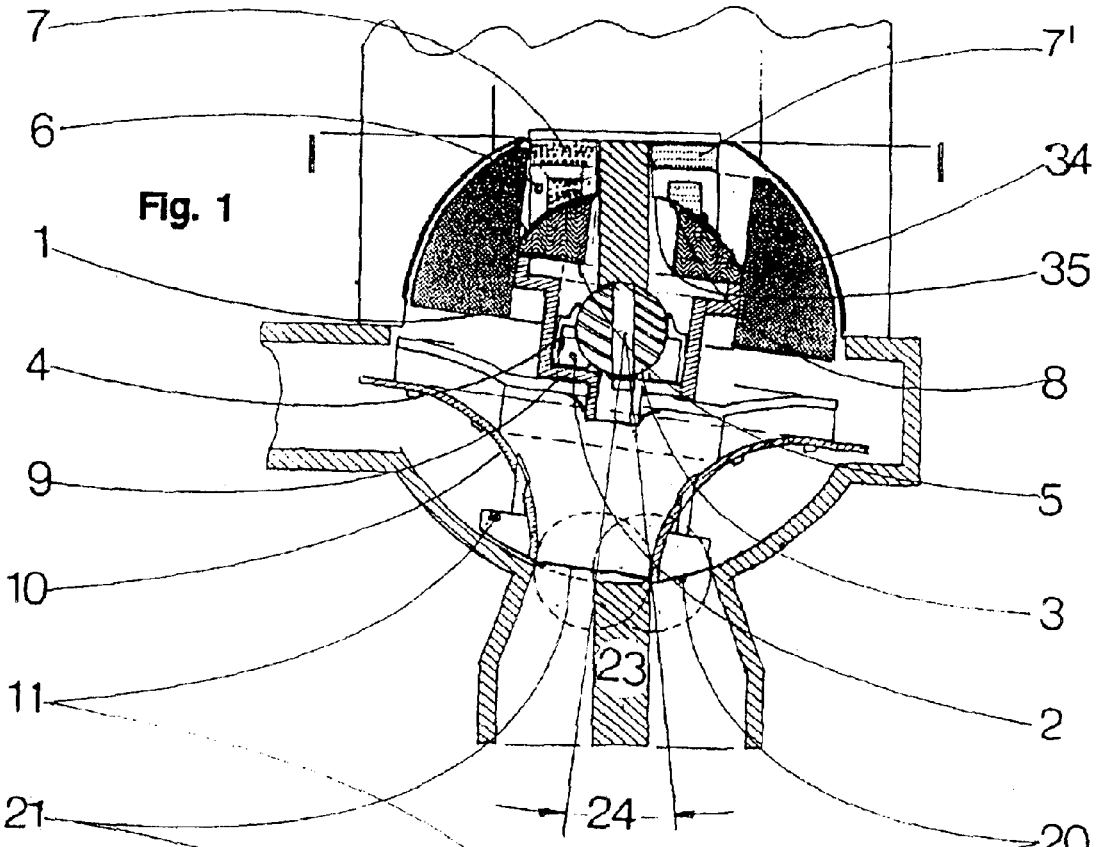
FIG. 1 shows a vertical cross-section through a circulator pump.

In FIG. 1 the magnet of the rotor 1 of a spherical motor is supported by bearing cap 2 on ball 3. A ring 4, whose diameter is smaller than the diameter of the ball 3, prevents a lift up of the rotor-pump-impeller unit 1, 10 when the motor is switched off. A permanent magnetic ring 5 in the form of a spherical ring is arranged within the inner diameter of the magnetic rotor 1. The magnetic poles form concentric rings and lie on a spherical surface. Above the permanent magnetic ring 5 two electromagnets 6 with windings 7 are arranged, which are sealed from the liquid conveyed by the spherical wall 8. Via a cap 9 the magnetic rotor 1 is connected to pump impeller 10, which has a ring-shaped counterbalance 11 at its suction side. The electromagnets 6 and 7 can tilt the rotating unit 1, 5, 9, 10 into the shown oblique position to the left or alternatively to the right side.

Figure 2:
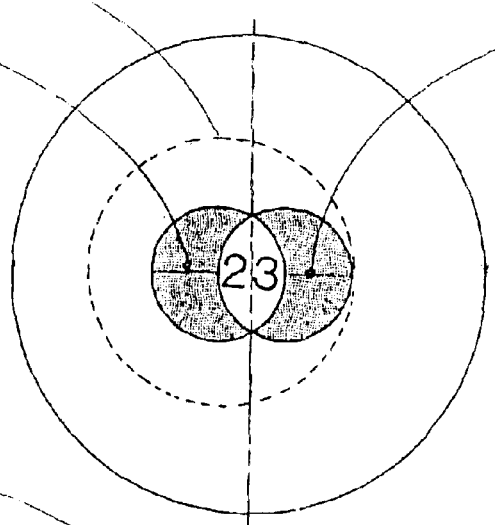
FIG. 2 shows the inside of the pump housing from above.

FIG. 2 shows the crescent-shaped inlet ports 20 and 21, which are separated from each other by an almost lenticular body 23. The ring 11 of the pump impeller 10 is shown dashed. While the left inlet port 21 is open to the pump impeller 10, the ring 11 closes the right inlet port 20. A tilt by an angle 24 blocks the opposite inlet port.

Figure 3:
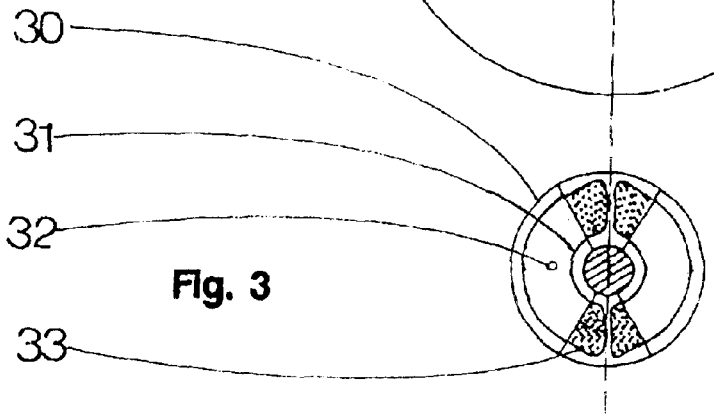
FIG. 3 shows the design of a double electro-magnet.

FIG. 3 shows a top-view of the electromagnets 6 and 7' below the sectional plane I—I. The magnetic pole areas 30 and 31 are connected to each other by yoke 32, which lies inside winding 33. The spherical end portions of the pole areas 30 and 31 face the permanent magnetic ring 5. The upper portion of the winding 33 above yoke 32 is not shown. The current runs through the windings right and left of the symmetry-line in opposite direction. As can be seen in FIG. 1, the left electro magnet 7 pulls the permanent magnet ring 5 to the inside while the right electro magnet 7' in which the current runs in the opposite direction pushes the ring 5 to the opposite side.

Figure 4:
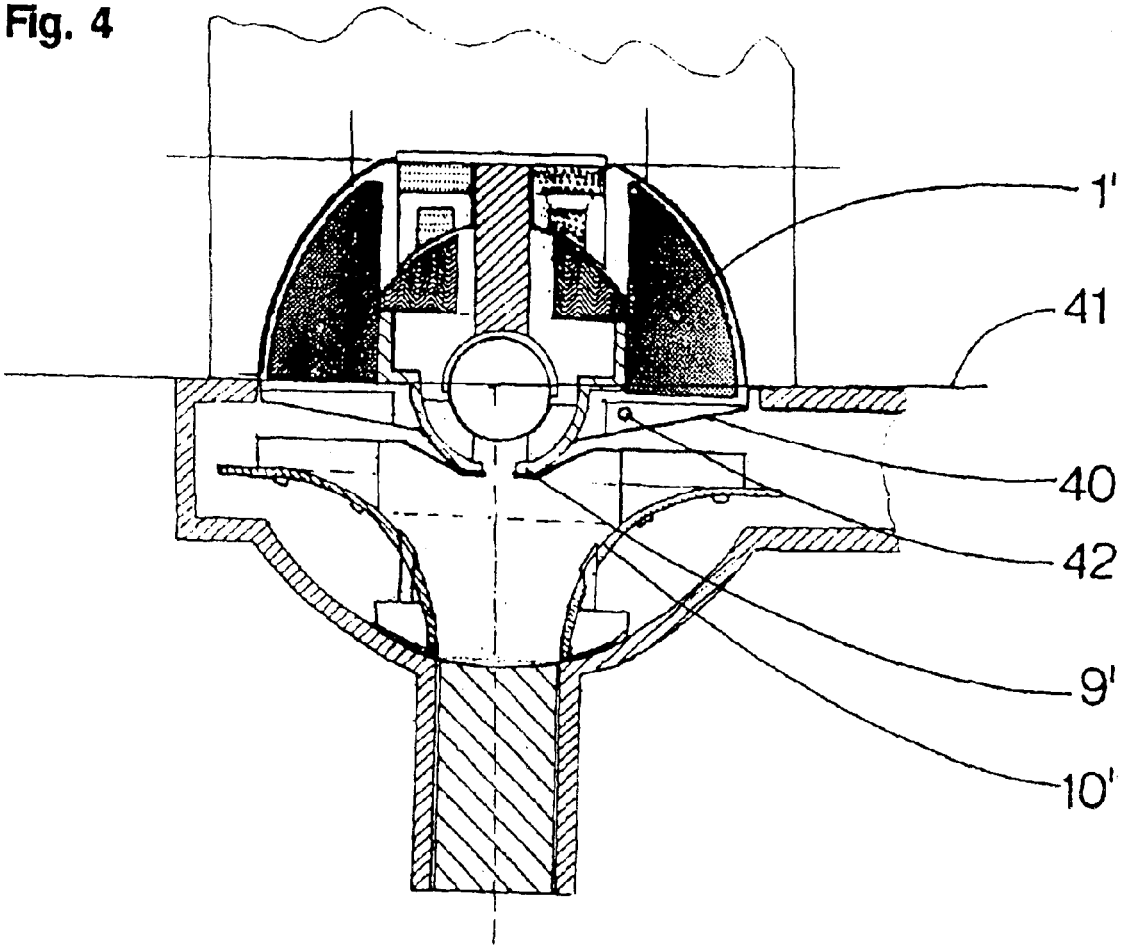
FIG. 4 shows a solution with a spherical ring at the inlet side of the pump impeller.

FIG. 4 shows another version, in which the concave space with the rotor 1' is separated from the pump area by a ring 40 which forms a narrow gap with the rotating hub 9', so that no dirt, for instance rust can get into the magnetic gaps. The axis 41 around which the rotor-pump impeller-unit 1', 10' can be tilted runs at a right angle to the view in FIG. 1. In the position in which the rotating unit 1', 10' is shown here the pump is not conveying. To prevent the flow of liquid within the annular space between the rotor 1' and the ring 40, which acts against the tilting of the rotating unit 1', 10' fins 42 are arranged parallel to the tilting axis 41.

Figures 5, 5A, 6:
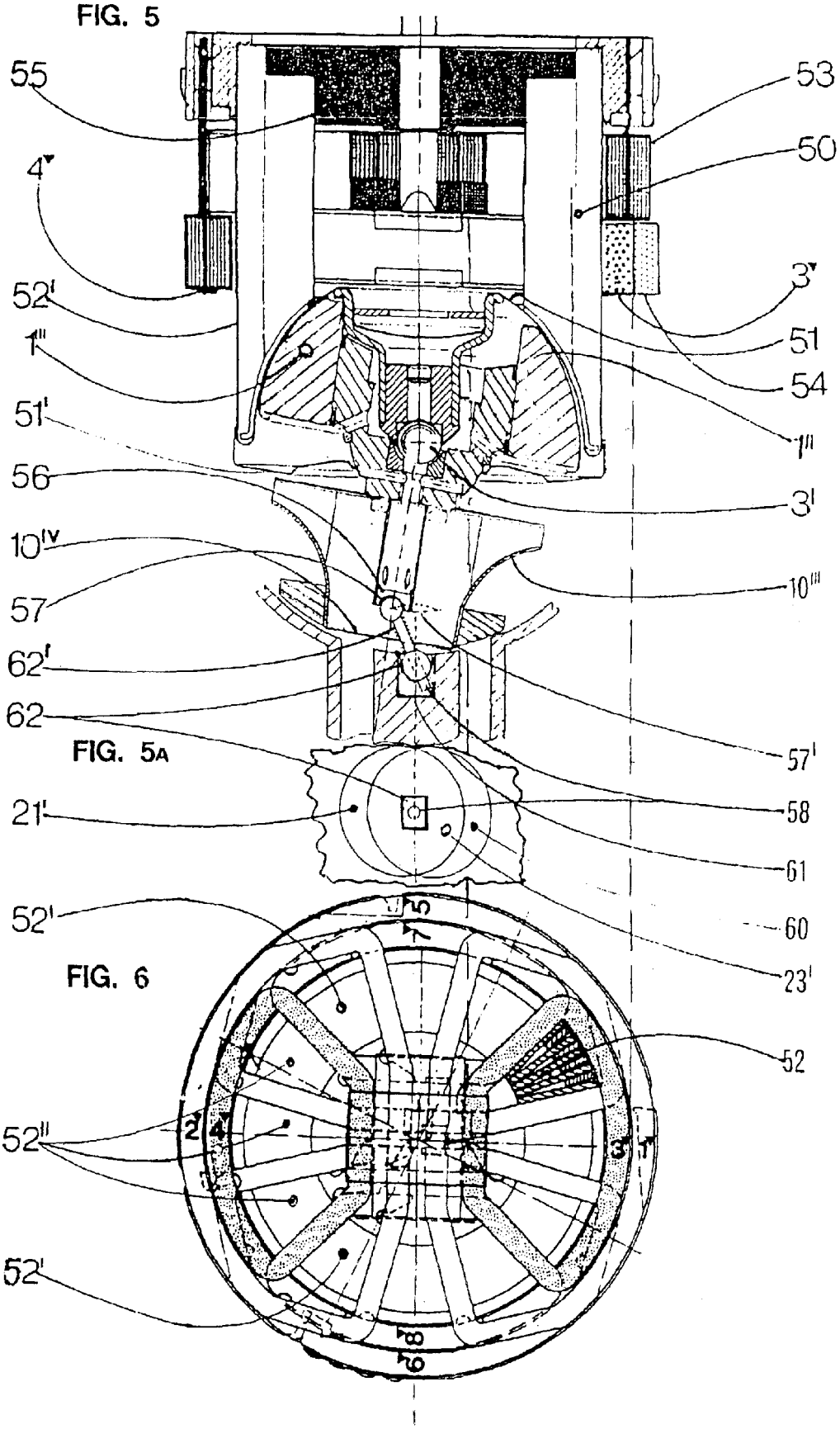
FIG. 5 shows a pump whose pump impeller is kept in a bi-stable position by a snap mechanism.
FIG. 6 shows a cross-section through the stator of the device of FIG. 5.

FIG. 5 and FIG. 6 show a cross section through spherical pump and the top view of the stator 50 without the rotor 1". FIG. 5*a* shows the crescent-shaped holes 21' and 60 and the lenticular dividing wall 23' lying in between.

In FIG. 6 the separating wall 51' is shown. The stator 50 has twelve poles 52. The windings are arranged between neighboring poles. They have two layers, 51 and 53. Each of these layers has two coils, 3* and 51. These coils are wrapped around the poles 52. When the pump is working alternating current is flowing through the coils which lie closest to the rotor 1'". Together with a similar set of coils they produce the rotating magnetic field. In contrast to the six other coils these coils 3* and 4* are conductively connected to a device—not shown—which can produce a strong DC current surge. By such a current surge through coil 4* the three poles 52" act as direct current magnets with a north polarization, while the poles 52' form the inherent south poles, whereby the poles 53' and 52' are magnetically connected via the iron yoke 55 so that they exert a strong attraction to the rotor side 1'" below, whereby the rotor-pump impeller-unit 1" and 10'" tilts around the horizontal axis 4' in FIG. 4 which runs through the center of bearing ball 3' and vertical to the plane of the picture. Within the pump impeller 10'" close to the suction port $\mathbf{10}^{IV}$ bearing cap 56 is situated which rotates with the pump impeller. Bearing ball 57 extends into the bearing cap 56. The bearing ball 57 forms a unit with a guiding rod 58, which slides within the bore of cylinder 62. The cylinder 62 is tiltably guided within the recess 61 of the stationary, lenticular separating wall 23' between the two crescent-shaped openings 60 and 21'. Between this cylinder 62 and the bearing ball 57 a helical spring 62' is situated whose force is sufficient to keep the rotating system 1'", 10'" in the respective sloping position. A change-over into the opposite sloping position is achieved by a DC current surge into coil 3*. Now the center of the bearing ball 57 moves along curve 57', whereby the spring 62' is compressed by a small amount.

I claim:

1. Circulator pump-motor unit with a spherical magnetic gap between a stator and a spherical armature, said armature being supported by a ball in the center and a bearing cap so that it can wobble within a predetermined angular interval, said armature forming a unit with an impeller having an inlet opening which faces a spherical stationary wall within a distance of working clearance whereby said stationary wall has two inlet openings laying side by side divided by a wall portion, each of said openings is connected through a channel with an inlet port and whereby said impeller can be tilted into a first position, so that said inlet opening of said impeller faces only one of said two openings while a ring portion being part of said impeller with a spherical outer surface covers the remaining opening so that fluid entering the first inlet port will be conveyed through the circulator pump while said ring portion covers the second opening and that the armature-impeller-unit can be tilted into a second position covering said first opening and conveying fluid from the second opening and the second inlet port through the circulator pump.

2. Circulator pump-motor unit according to claim 1, further comprising a pump housing with an inlet region with two crescent-shaped inlet openings (20, 21) separated by a lenticular-shaped dividing wall (23).

3. Circulator pump-motor unit according to claim 2, further comprising a spherical ring (11) at the entrance region of the pump impeller (10'), whereby the ring (11) closes one of the crescent-shaped openings (20, 21).

4. Circulator pump-motor unit according to claim 1, wherein a permanent magnet ring (5) moves the rotor (1) into an oblique position when the stationary electric magnet (6) is activated.

5. Circulator pump-motor unit according to claim 4, wherein the oblique position of the rotor is caused by a DC current-surge through an asymmetric DC-coil (3*) that moves the rotor-impeller-unit (1", 10''') between said first position and said second position.

6. A circulator pump-motor unit, comprising:

an impeller assembly adapted to selectively tilt between a first position and a second position, said impeller assembly having a suction port;

wherein said suction port is aligned with a first inlet while a second inlet is blocked when said impeller assembly is in said first position; and wherein said suction port is aligned with said second inlet while said first inlet is blocked when said impeller assembly is in said second position.

7. The circulator pump-motor unit according to claim 6, further comprising:

electromagnets adapted to actuate tilting of said impeller assembly.

8. The circulator pump-motor unit according to claim 6, wherein said first inlet and said second inlet are crescent-shaped and are separated by a lenticular-shaped dividing wall.

* * * * *